United States Patent [19]

Taylor

[11] 4,054,963

[45] Oct. 25, 1977

[54] ELECTRIC SHAVER HEAD CLEANING DEVICE

[76] Inventor: Clarence R. Taylor, 28 Woodside Drive, Penfield, N.Y. 14526

[21] Appl. No.: 660,616

[22] Filed: Feb. 23, 1976

[51] Int. Cl.[2] ..... A47L 7/00

[52] U.S. Cl. ..... 15/310; 15/319; 30/41

[58] Field of Search ..... 15/303, 310, 311, 339, 15/319, 218; 30/41, 41.5, 90

[56] References Cited

U.S. PATENT DOCUMENTS

| | | | |
|---|---|---|---|
| 2,023,955 | 12/1935 | Harvey | 15/315 |
| 3,120,886 | 2/1964 | Thalheim | 15/303 X |
| 3,172,416 | 3/1965 | Simmons | 15/310 X |
| 3,261,050 | 7/1966 | Caille et al. | 15/319 X |
| 3,295,204 | 1/1967 | Brophy | 15/405 X |
| 3,328,103 | 6/1967 | Bennett | 15/310 X |

*Primary Examiner*—Christopher K. Moore

[57] ABSTRACT

A device for cleaning the head of an electric shaver. The device comprises a housing having an air duct, a source of vacuum connected to one end of the duct, and a head receiving seat mounted in the housing and connected to the opposite end of the duct.

7 Claims, 8 Drawing Figures

ELECTRIC SHAVER HEAD CLEANING DEVICE

BACKGROUND OF THE INVENTION

1. Field of the Invention

This invention relates generally to cleaning devices, and more specifically to a device for cleaning the head of an electric shaver.

2. Description of the Prior Art

It is known in the prior art to clean the head of an electric shaver by partially or completely disassembling the head and cleaning the parts thereof with a brush and/or a cleaning solvent. Such a cleaning operation is annoying, inconvenient and messy. Also, for those users that are not mechanically inclined, the disassembling and assembling operations are difficult, and sometimes damage to the shaver parts may occur due to improper disassembly and assembly. As a consequence of the aformentioned disadvantages, the shaving heads of some electric shavers are rarely cleaned, thus reducing the life and working efficiency of the shaver.

SUMMARY OF THE INVENTION

In accordance with a preferred embodiment of the invention, an electric shaver head cleaning device is disclosed comprising a housing for supporting an air duct. A shaver head receiving means is mounted in the housing and connected to one end of the duct. The housing further supports a vacuum forming means connected to the opposite end of the duct for generating a flow of air through the shaver head receiving means and through the assembled head of a shaver seated therein for removing hair clippings from the head. In a further embodiment of the invention, the head receiving means comprises an opening in the housing, and a flexible or resilient head receiving seat mounted in the opening. The seat is substantially cup-shaped with its inner periphery generally corresponding to the outer shape of a shaver head inserted therein. The inner periphery of the seat is preferably provided with one or more grooves for allowing air flow into and through the grill of the assembled head of the shaver. In a still further embodiment of the invention, the cleaning device is provided with switching means for electrically connecting the vacuum forming means to a power source for a predetermined time interval. The switching means may comprise a first switch in a normally open position, switch actuating means such as a clock motor and cam adapted when energized to close the first switch for a predetermined time, and a second switch for momentarily energizing the clock motor.

One of the advantages of this invention is to provide a device for cleaning the head of an electric shaver without disassembling the head. The cleaning device further provides a convenient receptacle for the shaver following use thereof, and is so convenient and easy to operate that the user will invariably clean the shaver head after each shave. Such frequent cleaning minimizes shaver maintenance, improves the operating efficiency of the shaver, and prolongs its life. The invention and its advantages will become more apparent from the detailed description of the preferred embodiments presented below.

BRIEF DESCRIPTION OF THE DRAWING

In the detailed description of the preferred embodiments of the invention presented below, reference is made to the accompanying drawing, in which.

DESCRIPTION OF THE PREFERRED EMBODIMENTS

Because cleaning devices are well-known, the present description will be directed to elements forming part of, or cooperating more directly with, apparatus in accordance with the present invention. Cleaning device elements not specifically shown or described should be understood to be selectable from those known in the art.

Figure 1:
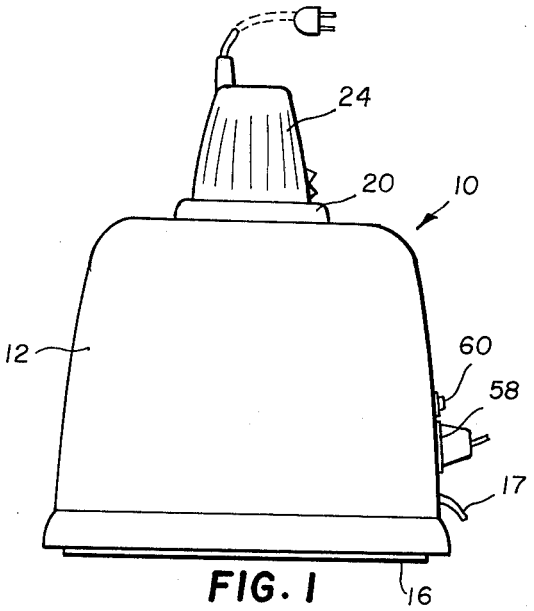
FIG. 1 is a side elevational view of a preferred embodiment of the electric shaver head cleaning device of this invention.
Figure 2:
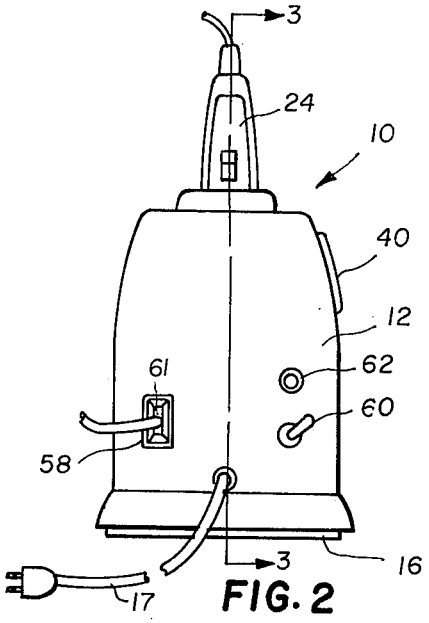
FIG. 2 is an end elevational view of the cleaning device.
Figure 3:
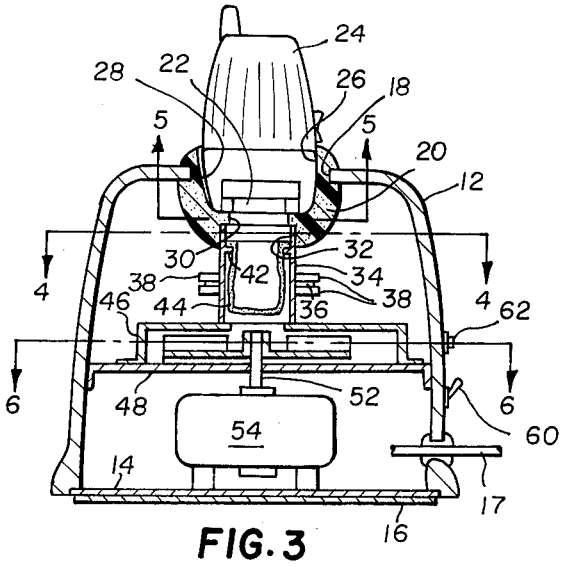
FIG. 3 is a section view taken substantially along line 3—3 of FIG. 2.
Figure 4:
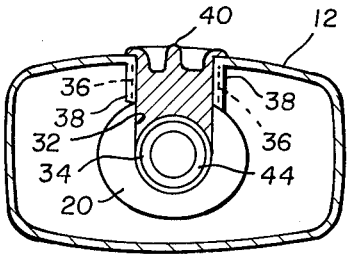
FIG. 4 is a section view taken substantially along line 4—4 of FIG. 3.

With reference to FIGS. 1–6, a preferred embodiment of an electric shaver head cleaning device 10 is disclosed comprising a housing 12 having a base plate 14 provided with a non-slip covering 16. The upper end of housing 12 has an opening 18 (FIG. 3) for detachably supporting a substantially cup-shaped seat 20 for receiving the head 22 of an electric shaver 24. The seat 20 is formed of any suitable flexible or resilient material such as foam plastic, rubber or the like, and has a peripheral groove for receiving the peripheral edge of opening 18 when the seat is mounted on the housing as best seen in FIG. 3. The inner periphery 26 of the cup-shaped portion of seat 20 conforms to the outer periphery of the shaver head 22 and a portion of the shaver 24 when the shaver is placed in seat 20. The inner periphery 26 of the cup-shaped portion of seat 20 may further be provided with one or more grooves 28 to allow outside air to be drawn through the grooves and through the assembled head 22 of the shaver during a cleaning operation. The bottom or lower end of cup-shaped seat 20 is provided with an opening 30 (FIG. 5) in register with the grill 23 (FIG. 5) of head 22 of shaver 24 and conforming to the shape of the head. The seat 20 is further provided with a cavity 32 (FIGS. 3 and 4) beneath and in register with opening 30 for receiving one end of a cylindrical duct 34. The duct 34 has laterally extending ribs 36 secured thereto slideably mounted between stationary rails 38 secured to the housing by any suitable means. The duct 34 further has a handle 40 secured thereto which extends through an opening in housing 12 and by which the duct can be manually slid into and out of register with opening 30 in seat 20. The duct 34 further has an inner ring 42 for supporting the annular lip of any suitable air permeable bag 44 adapted to receive the hair clippings from shaver head 22. The lower end of duct 34 slideably engages the upper wall surface of an impeller housing 46 (FIG. 3) secured to a support plate 48, which is in turn secured to housing 12 of the cleaning device. A vacuum pump impeller 50 is mounted within impeller housing 46 onto an impeller shaft 52 extending through an opening in support plate 48. Shaft 52 and impeller 50 are rotatably driven by a motor 54 mounted on base 14, and the impeller housing 46 has an exit opening 56 (FIG. 6) in the wall of housing 12. Upon operation of motor 54, impeller 50 draws air through seat 20, the assembled head 22 of a shaver 24 seated in the seat, the duct 34 and bag 44, and then expells the air through opening 56. The hair clippings in shaver head 22 are drawn through grill 23 into bag 44 which may be periodically emptied or replaced.

Figure 7:
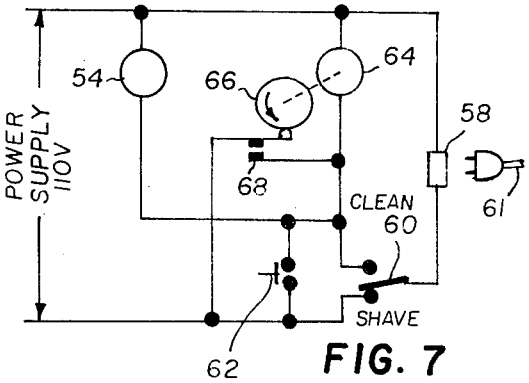
FIG. 7 is a typical electrical circuit diagram for the cleaning device of this invention.

With reference to FIG. 7, a typical electrical wiring diagram for the cleaning device of this invention is disclosed. The cleaning device 10 is connected by any suitable electrical cord and plug 17 to a normal 110 volt power supply. The cleaning device further has a utility power outlet 58 mounted on housing 12 and which is normally connected to the power supply when a toggle lever switch 60 is switched to a "shave" position. In this position, a person may insert a plug 61 of his electric shaver 10 into utility outlet 58 for operation. Following a shaving operation, the person can both dispose of shaver 10 and clean it by inserting the shaver into head receiving seat 20 as illustrated in FIGS. 1–3, moving toggle switch 60 to the "clean" position disconnecting the power supply to utility outlet 58 and shaver 24, and then momentarily depressing a start switch 62. This connects power to vacuum motor 54 which rotates impeller 50 for drawing air through shaver head 22, and also to a clock motor 64 which drives a cam 66 through a single revolution. Initial movement of cam 66 closes a microswitch 68 bypassing start switch 62 to continue supplying power to motors 54, 64 upon release of start switch 62. When cam 66 completes the single revolution, microswitch 68 is opened terminating the operation of the motors. During the cleaning cycle, it is preferable to leave switch 60 in the "shave" position and to keep shaver 10 plugged into utility outlet 58. This results in operation of the shaver during the cleaning operation setting up a whirlwind action inside head 22 to keep the hair clippings suspended, and facilitating the removal of the clippings from head 22 through grill 23.

Figure 8:
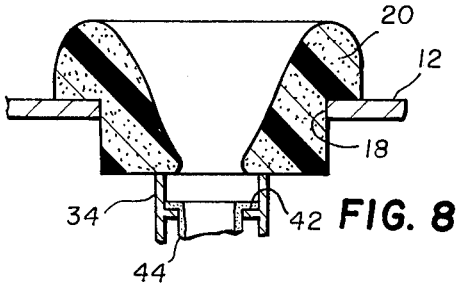
FIG. 8 is an enlarged segmental view showing a universal head receiving seat of the cleaning device.
Figure 6:
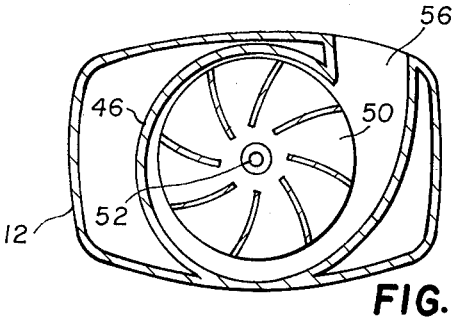
FIG. 6 is a section view taken substantially along line 6—6 of FIG. 3.
Figure 5:
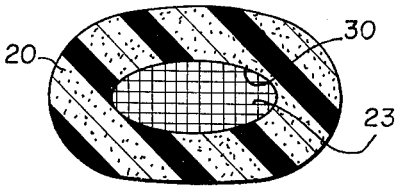
FIG. 5 is an enlarged section view taken substantially along line 5—5 of FIG. 3.

With reference to FIG. 8, a universal head receiving seat 20' is illustrated which is capable of accommodating shavers having shaver heads 22 of different shapes. This is possible because seat 20' is made sufficiently thick and flexible with sufficient give or elasticity to conform to the varied shapes of shaver heads on the market.

The invention has been described in detail with particular reference to preferred embodiments, but it will be understood that variations and modifications can be effected within the spirit and scope of the invention as described.

What is claimed:

1. An electric shaver head cleaning device comprising:

a housing having a first opening in the top thereof and a second opening;

a duct in said housing;

means mounted in said first opening in said housing and connected to one end of said duct for receiving the head of an electric shaver;

means in said head receiving means for allowing the passage of air from the exterior of said housing through the shaver head into said duct;

vacuum forming means including a first motor mounted within said housing, said vacuum forming means having an intake end and an exhaust end with said exhaust end connected to the opposite end of said duct for forming a vacuum in said head receiving means when siad first motor is connected to a power source for drawing air exterior of said housing through the shaver head; and electrical circuit means including energization means adapted when energized for electrically connecting said first motor to the power source for a predetermined time interval.

2. The shaver head cleaning device according to claim 1 wherein said head receiving means comprises a flexible head receiving seat mounted in said first opening; and said electrical circuit means comprises a first switch in a normally open position and in series with said first motor, drive means adapted when momentarily energized to close said first switch and electrically connect said first motor to the power source for a predetermined time, and said energization means comprises a second switch for momentarily energizing said drive means and said first motor.

3. The shaver head cleaning device according to claim 2 wherein said seat is substantially cup-shaped with the inner periphery of one end of said seat corresponding to the outer shape of the shaver head, said seat further having a seat opening in the opposite end thereof in register with the shaver head.

4. The shaver head cleaning device according to claim 3 wherein said air passage means comprises at least one groove for allowing air from the exterior of said housing to enter the head of the shaver.

5. The shaver head cleaning device according to claim 4 wherein said duct is removable from said housing, said duct further having means for supporting a bag for collecting the hair clippings removed from the shaver head.

6. An electric shaver head cleaning device comprising:

a housing having an opening;

a duct in said housing;

a flexible cup-shaped seat mounted in said opening in said housing and connected to one end of said duct for receiving the head of an electric shaver, the inner periphery of one end of said seat corresponding to the outer shape of the shaver head and being provided with at least one groove for allowing air from the exterior of said housing to enter the head of the shaver, said seat further having a seat opening in the opposite end thereof in register with the shaver head; and vacuum forming means mounted within said housing and connected to the opposite end of said duct for removing hair clippings from the shaver head.

7. The shaver head cleaning device according to claim 6 wherein said duct is removable from said housing, said duct further having means for supporting a bag for collecting the hair clippings removed from the shaver head.

* * * * *